United States Patent [19]

Kawaharada et al.

[11] 4,070,668

[45] Jan. 24, 1978

[54] DISPLAY DEVICE

[75] Inventors: Masaru Kawaharada, Fuchu; Etsuso Yokoyama, Tachikawa, both of Japan

[73] Assignee: Citizen Watch Company Limited, Tokyo, Japan

[21] Appl. No.: 697,788

[22] Filed: June 21, 1976

[51] Int. Cl.[2] ..... G08B 5/22

[52] U.S. Cl. ..... 340/373; 340/378 R; 340/336

[58] Field of Search ..... 340/373, 378 R, 336 R

[56] References Cited

U.S. PATENT DOCUMENTS

| | | | |
|---|---|---|---|
| 2,141,473 | 12/1938 | Hubertz | 340/373 |
| 3,273,270 | 9/1966 | Skrobisch | 340/373 |
| 3,731,303 | 5/1973 | Wohlbach | 340/373 R |
| 3,886,545 | 5/1975 | Skrobisch | 340/336 |

*Primary Examiner*—Harold I. Pitts
*Attorney, Agent, or Firm*—Holman & Stern

[57] ABSTRACT

A segmental display device includes a window plate having a plurality of segmental openings for indicating selected characters. A plurality of closure members are supported on a rotatable shafts extending in parallel to the plurality of segmental openings, respectively, and adapted to close selected one of the plurality of segmental openings to indicate the selected characters. A plurality of actuating units are mounted on the window plate adjacent the segmental openings, respectively, and operatively connected to the rotatable shafts for selectively rotating the closure members. Light is provided from a source within a casing, so that the display contrast and visibility will effectively increase as the level of ambient lighting decreases.

10 Claims, 17 Drawing Figures

DISPLAY DEVICE

BACKGROUND OF THE INVENTION

This invention relates to indicating devices and, more particularly, to a segmental display device for the display of digital or alphanumeric information.

In conventional segmental devices, the segments making up the displayed digits or letters are composed by changing the reflectivity of parts of a display panel. With such a device, since the degree of contrast between the display segments and the display panel is dependant upon the amount of light impinging on them, the display visibility will accordingly be dependant upon the level of ambient light.

SUMMARY OF THE INVENTION

In the present invention, however, light is provided from a source within the device itself, so that the display contrast and visibility will effectively increase as the level of ambient lighting decreases. In addition, in the present invention, means by which the segments of the display are illuminated can be arranged such that there is no obstruction presented to the passage of light from the illuminating source through the display segments.

In the present invention, each display segment comprises an aperture or window in a window plate, adjacent to which is mounted a flap or shutter referred to herein as a closure member, of similar dimensions to the window, which can be rotated into two distinct positions by means of a magnetic actuating mechanism, such that light from a source at the rear of the device can either pass through the segment window or is blocked from passage.

The segment windows are arranged in an "8" shaped array. A separate electromagnetically operated actuating unit is provided for each of the closure members, such that the application of a single pulse of electric current to an actuating unit causes display or blanking of the corresponding window segment to occur. Each actuating unit contains a bipolar permanent magnet, referred to hereinunder as a magnetic element, and an electromagnet which causes the magnetic element to rotate when a current pulse as described above is applied. The magnetic element is mechanically coupled to a closure member by means of an actuating lever and an actuating arm, such that when the magnetic element is caused to rotate about an axis parallel to the plane of the window plate the closure member is caused to be moved into a position parallel to or at right angles to the window plate, depending upon the direction of rotation of the magnetic element. This direction of rotation is determined by the polarity of the current pulse applied to the electromagnetic of the actuating unit. The actuating arm and the actuating lever are constructed such that two fixed limiting positions for movement of the magnetic element and the closure member are established; in one position the closure member permitting light to pass through the segment window and in the other position the closure member causing the passage of light through the window to be blocked, thereby blanking out the corresponding segment.

The electromagnet, magnetic element, actuating lever, actuating arm and closure member corresponding to one segment are all mounted upon a single bracket, this bracket in turn being mounted on the window plate. The closure member and the magnetic element are rotatably supported on this bracket such that they can rotate about an axis parallel to the plane of the window plate. The electromagnet is fixed to the bracket in a stationary position, with the electromagnet poles adjacent to the magnetic element.

The closure member may have a flexible shutter panel attached to its front face by means of a spacer element if desired, ensure silence of operation and complete blockage of light when the corresponding segment is blanked off, however this is not an essential feature of the present invention. To ensure that no interference to operation can result due to mechanical contact between adjacent closure members while relative movement is taking place, one of the closure members is mounted such that it abuts against a frame which separate the closure member from the window plate by a certain minimum disance relative to the position of abutment of the other closure members with the window plate.

The color of the displayed segments may be determined by means of a colored filter situated in front of the window plate. Alternatively, colored translucent window insets may be incorporated in the window plate to provide the same effect. To increase display contrasts, a darktinted front plate may be provided in front of the filter, or in front of the segment window plate if no filter is used.

It is, therefore, a principal object of the present invention to provide a segmental display device which has a high degree of display visibility under a wide range of conditions of ambient lighting.

It is another object of the present invention to provide a segmental display device which has a low cost of manufacture and a high degree of reliability in performance.

It is another object of the present invention to provide a segmental display device which has display segments disposed in an "8" shaped array and where the segments are made visible by permitting light to pass through segment windows or apertures corresponding to the segments from a light source provided within the device.

It is another object of the present invention to provide a segmental display device of the character described wherein the operation of blocking or permitting passage of light through a segment window is controlled by acutation of a bipolar permanent magnet element by means of discrete pulses of electric current applied to an electromagnet situated adjacent to the magnet element.

It is further object of the present invention to provide a segmental display device combined with an electric circuitry of an electronic timpiece to provide a time display.

It is a still further object of the present invention to provide a segmental display device adapted to automatically stop segmental display to prevent incorrect display of data.

BRIEF DESCRIPTION OF THE DRAWINGS

These and other objects, features and advantages of this invention will become more apparent from the following detailed description when considered in conjunction with the accompanying drawings, in which.

DETAILED DESCRIPTION OF A PREFERRED EMBODIMENT

Figure 1:
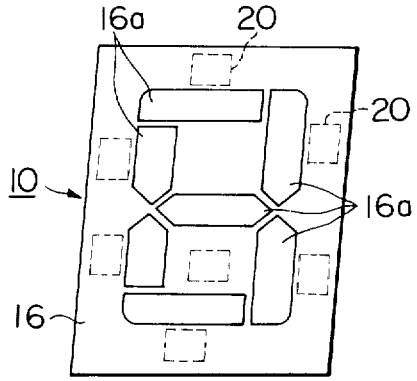
FIG. 1 is a front elevation view of a display device according to the present invention.

Referring now to the drawings, wherein like reference characters designate like or corresponding component parts throughout, there is illustrated in FIG. 1 a segmental display device 10 according to the present invention. The display device 10 comprises a front plate 12 which is comprised of a translucent material tinted some darkcolor in a manner such as smoked glass, a color filter 14 and a window plate 16, which are provided on an open end of a casing 17. Elongated openings referred to herein as segment openings or windows 16a are formed in window plate 16 and may be provided with light diffusing type white colored translucent material, such that light from a rear-mounted light source or sources 18 passes through the segment windows 16a to the exterior of the device by way of color filter 14 and front plate 12, thereby making the segments visible. The color of the displayed segments is determined by the color of the color filter 14. Situated adjacent to each of the segment windows is an actuating unit 20 to which is mechanically coupled a rotatably mounted closure member 22 such that the actuating unit 20 can be electrically actuated to rotate the closure member 22 into either of two mechanically stable positions. In one of these positions the closure member 22 permits light from the light source 18 to pass through the segment window 16a and in the other position the closure member 22 blocks the passage of light through the segment window 16a so that the corresponding segment is blanked off. The segment windows 16a are arranged in a conventional "8" numeral configuration such that any digit from 0 to 9 may be displayed be selectively rotating certain ones of the closure members so as to permit the passage of light through segment windows corresponding thereto.

Figure 2:
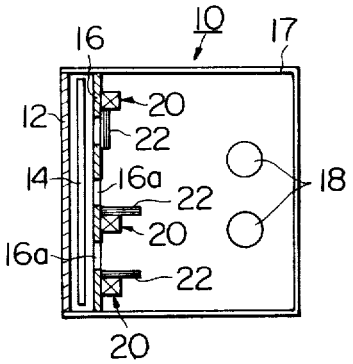
FIG. 2 is a vertical sectional view of the display device shown in FIG. 1.
Figure 3:
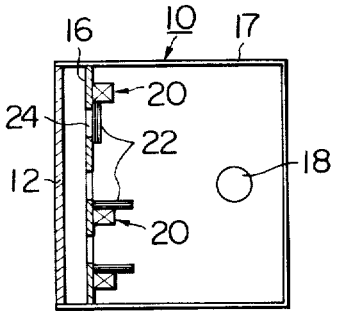
FIG. 3 is similar to FIG. 2 but shows a modified form of the device shown in FIG. 1.

FIG. 3 illustrates a modification of the embodiment shown in FIGS. 1 and 2. In the modification of FIG. 3, panels of light diffusing type colored translucent material 24 are set into each of the segment window openings. With this modification, the color filter 14 shown in FIG. 2 is no longer required, since the color of the displayed numeral is determined by that of the inset translucent panels 24.

Figure 4:
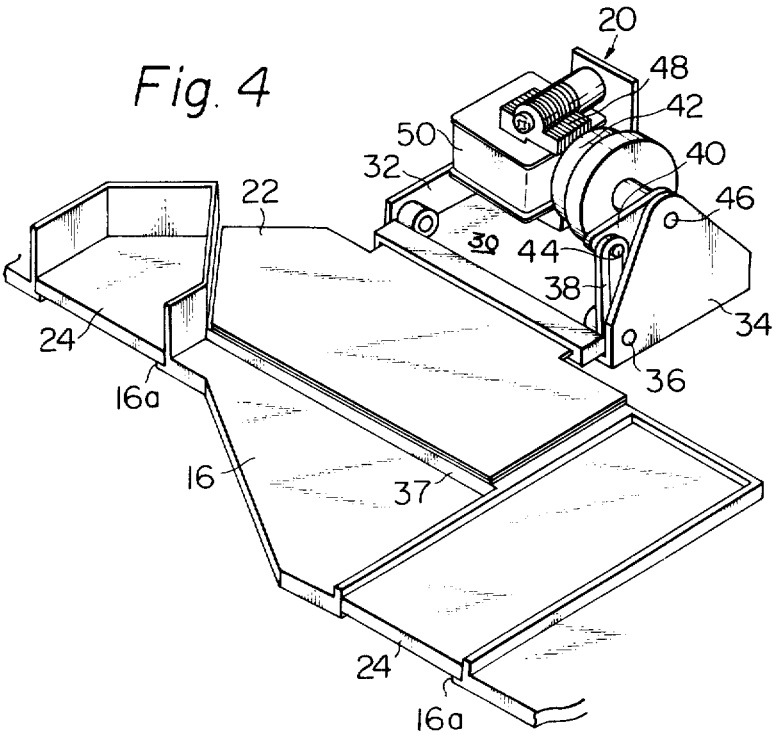
FIG. 4 is a perspective view of a preferred example of an actuating unit and closure member forming part of the display device shown in FIG. 2.

Referring now to FIG. 4, a perspective view of one of the actuating units 20 and the closure member 22 is shown. The actuating unit 20 is mounted upon a bracket comprising a baseplate 30 to which is affixed at right angles flanges 32 and 34. The closure member 22 is rotatably mounted by means of a rotatable shutter shaft 36 the ends of which are inserted into bearing holes in flanges 32 and 34. The closure member 22 abuts against a frame 37 surrounding the segment window opening when the corresponding segment is in the blanked off condition. The closure member 22 is mechanically coupled by means of a linkage composed of a slotted actuating arm 38 and an actuating lever 40 to a magnetic element 42 which consists of a bipolar permanent magnet. The actuating lever 40 is provided with an engaging pin 44 at one of its ends, pin 44 being arranged such that it can move slidably within the slotted portion of actuating arm 38. The magnetic element 42 is rotatably mounted on the flange 34 by a rotor shaft 46 and is rigidly coupled to the actuating lever 40 such that when the magnetic element 42 is caused to rotate, the closure member 22 is caused to be rotated into a position either abutting against the frame 37 or at right angles to the plane of the frame 37, the direction of movement of closure member 22 being determined by the direction of rotation of the magnetic element 42.

Affixed to the baseplate 30, or to a flange mounted thereon, is an electromagnet comprising a core 48 and an electromagnetic coil 50. Flat surfaces of the core 48 which become magnetically polarized when an electric current is passed through the electromagnetic coil 50 are arranged in proximity to the magnetic element 42 so as to cause rotation of the magnetic element 42 by magnetic attraction or repulsion, when the electromagnetic core 48 becomes polarized. The direction of rotation of the magnetic element 42, and accordingly the direction of movement of the closure member 22, is determined by the direction in which current is caused to flow through the coil 48. Since the closure member 22 is in a state of mechanical stability for both the raised and lowered conditions, the position of the closure member 22 may be changed by application of a momentary pulse of current to the electromagnetic coil 48. The position of the closure member 22 may then be subsequently changed over by application of a current pulse of opposite polarity at some later time.

Figure 5A:
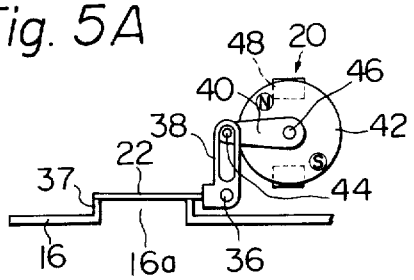
FIGS. 5A, 5B and 5C are partial views illustrating the method of coupling between an actuating unit and a closure member.
Figure 5B:
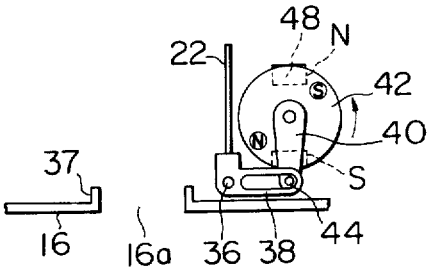
Figure 5C:
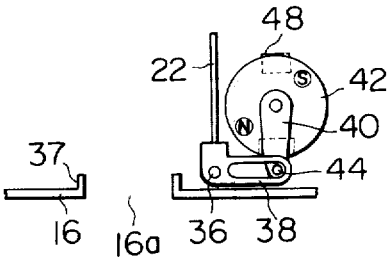

FIGS. 5A through 5B illustrate the way in which movement of the magnetic element 42 is transmitted to the closure member 22 by means of actuating arm 38 and actuating lever 40. FIG. 5A shows the closure member 22 in the closed position, such that light is blocked from passing through the corresponding segment window 16a. FIG. 5B shows the application of a magnetic field by the electromagnet 48 shown in FIG. 4, the filed polarity being such as to rotate the magnetic member 42 in the direction shown in FIG. 5B causing the closure member 22 to be rotated into the upright or open position. FIG. 5C shows the condition of the closure member 22 after current has ceased to flow in the electromagnet coil. The closure member 22 has now been moved into the stable position in which the corresponding segment is made visible.

Figure 6:
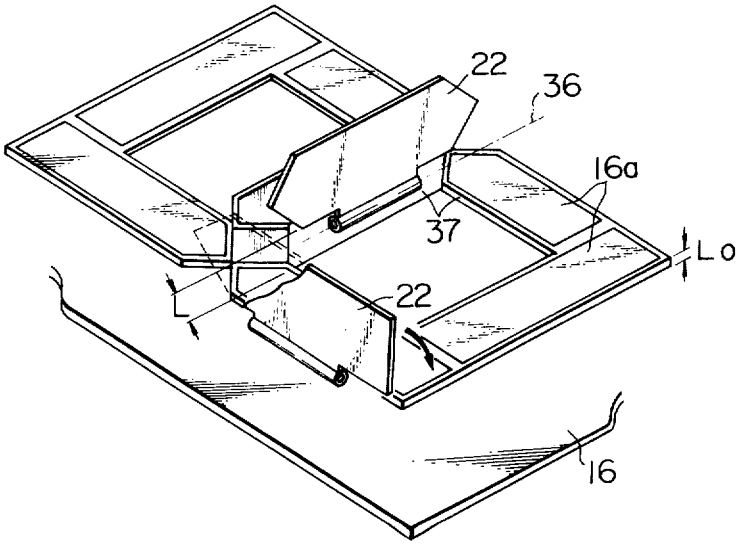
FIG. 6 is a partial perspective view of the rear of a window plate, illustrating the method of arrangement of the closure members thereon.
Figure 7:
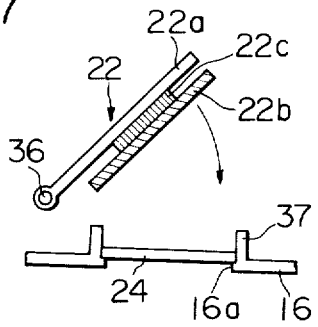
FIGS. 7, 8, 9 and 10 are fragmentary views illustrating the attachment of a flexible shutter panel to the closure member.

FIG. 6 illustrates the rear of the segment window plate 16, showing the way in which the various closure members are arranged to abut against corresponding frames 37 surrounding window segments 16a. Also illustrated is the manner in which one of the frames is arranged to be of a height L above the window plate, while all other frames are at a height $L_O$ above the window plate, L being greater than $L_O$. This constitutes a means whereby mechanical interference between adjacent closure members 22 when they are in relative motion is prevented, and greater releability of operation is ensured.

Figure 8:
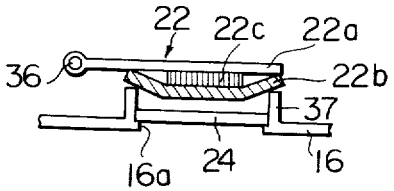
Figure 9:
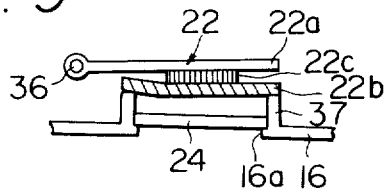
Figure 10:
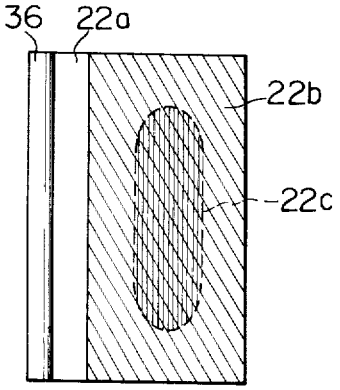

FIGS. 7, 8, 9 and 10 show an example of the closure member 22. The closure member 22 is composed of a closure plate 22a, and a flexible shutter sheet 22b attached to the closure plate 22a by means of a spacer 22c which is of smaller dimensions than the shutter sheet 22b. FIG. 8 shows how the shutter sheet 22b functions to absorb the impact of the closure member 22 against the frame 37, thereby reducing noise generated thereby. FIG. 9 shows the position of the shutter sheet 22b with the closure member 22 in the closed position. It can be seen that the shutter sheet 22b effectively blocks out the passage of light from the rear-mounted source 18 shown in FIG. 2 even in a case where the axis of rotatable shaft 36 is placed in incorrect position with respect to the frame 36. The use of such a shutter sheet 22b is not however essential to the proper functioning of the present invention, and, further, the spacer 22c may be dispensed with.

Figure 11:
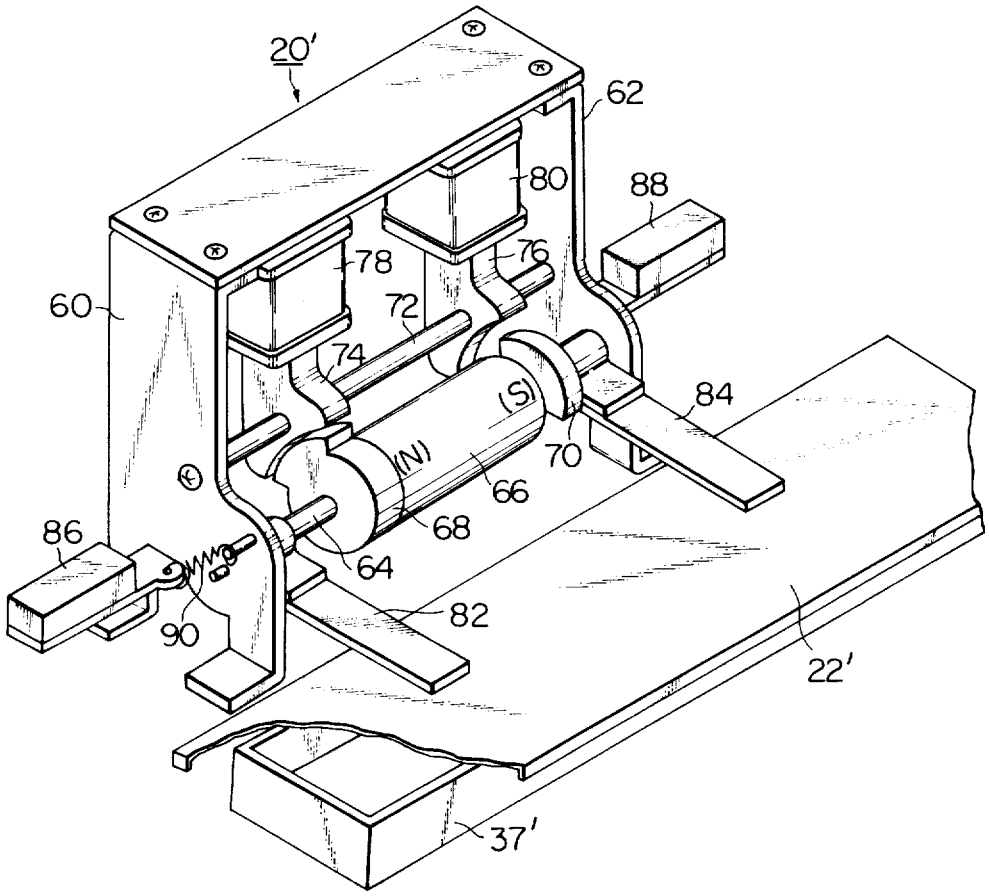
FIG. 11 is a perspective view of component parts of a second preferred example of the actuating unit, showing the actuating unit and a closure member attached thereto.

FIG. 11 is a perspective view showing another preferred example of the construction of an actuating unit 20' and closure member 22'. A pair of frames 60 and 62 are mounted on the window plate and carry a rotatably mounted shaft 64 on which is axially fixed a permanent magnet 66 with specially shaped pole pieces or magnetic elements 68 and 70 mounted at each end. The pole pieces 68 and 70 are constructed to be of varying diameter, so that lobed portions are formed upon each as shown in FIG. 11. Affixed to a crosspiece 72 connecting the brackets 60 and 62 are two electromagnetic yokes 74 and 76 shaped so as to partically surround the magnetic elements 68 and 70. Around each yoke is mounted an electromagnetic coil 78 and 80, utilized to magnetically energize the yokes 78 and 80. A closure member 22' is affixed to the shaft 64 by means of arms 82 and 84. Diametrically opposite to the closure member 22' are also mounted on the shaft 64 a pair of balance weights 86 and 88, provided to counterbalance the closure member 22' and thereby ensure mechanical stability of the closure member 22' in both the open and closed positions. A retaining spring 90 is provided to maintain the shaft 64 in the correct position.

Figure 12:
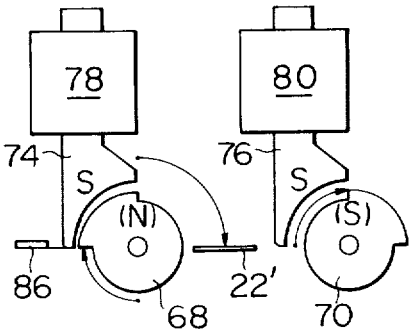
FIGS. 12 and 13 are partial views illustrating the disposition of the magnetic elements of the actuating unit shown in FIG. 11 for the closed and open positions of the closure members, respectively.
Figure 13:
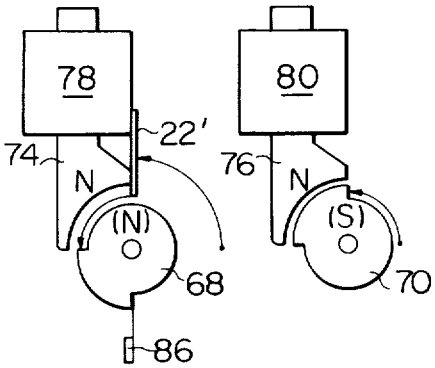

The functioning of this embodiment will be clearly understood by reference to FIGS. 12 and 13. FIG. 12 shows how, when a current is passed through the electromagnetic coils 78 and 80 such that yoke 74 takes a south polarity and yoke 76 also takes a south polarity, the opposing north and south poles of the magnetic elements 68 and 70 are respectively attracted and repelled. The lobed configuration of the magnetic elements serves to intensify the magnitude of the repulsive and attractive forces developed thereby. FIG. 12 illustrate the case in which current is passed through the electromagnetic coils 78 and 80 in such a direction as to cause the closure member 22' to be rotated into the closed position. FIG. 13, on the other hand, illustrates the case in which current is passed through the electromagnetic coils 78 and 80 in the opposite direction to that for FIG. 12. In this case the north pole magnetization of magnetic element 68 causes it to be repelled by the yoke 74 and the south pole magnetization of magnetic element 70 causes it to be attracted by the yoke 76. As was true for the first embodiment of the invention, the closure member 22' can be rotated from the open to the closed position or vice versa by application of a single current pulse of the appropriate polarity to the electromagnetic coils 78 nd 80.

Figure 14:
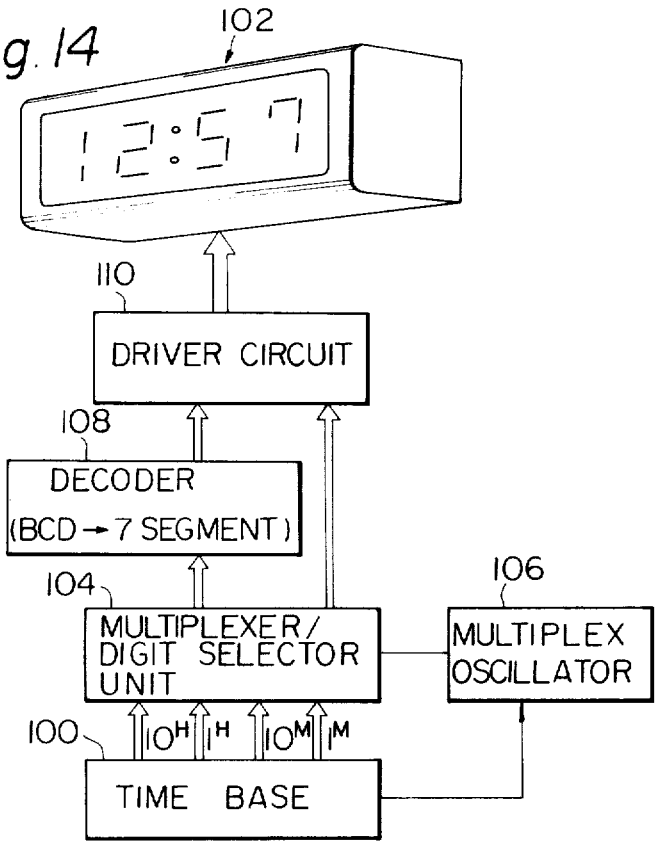
FIG. 14 is a block diagram of an electronic timepiece combined with the display device according to the present invention.

FIG. 14 shows an example of an arrangement in which a display unit of the present invention is combined with an electronic timepiece to display time information. A time base 100 usually includes a frequency standard and a frequency divider, though not shown, which divides a constant frequency signal generated the frequency standard to provide accurate time data including hour's tens signal, hour's units signal, minute's tens signal and minute's units signal indicated as 10H, 1H, 10M and 1M, respectively, in FIG. 14. This data is used to periodically update a display unit 102, which incorporates segmental displays according to the present invention, the updating being performed at suitable frequent time intervals. The selection of display digits for updating is performed by means of selector pulses generated by a multiplexer/digit selector unit 104. A multiplex oscillator 106 is coupled to the time base 100 to receive a timing signal every one minute, and generates four triggering signals every one minute in response to the timing signal from the time base 100. These triggering signals are applied to the multiplexer/digit selector unit 104. The multiplexer/digit selector unit 104 is responsive to the triggering signals from the oscillator 106 to generate multiplexed BCD output signals in response to time data provided by the time base 100. The BCD output signals are applied to a BCD-7 segment decoder 108, which converts the multiplexed BCD output signals into suitable form to provide decoded output signals. These decoded output signals are applied to a driver circuit 110, which provides drive signals to drive actuating units of the display unit 102. The multiplexer/digit selector unit 104 also generates digit selector signals, which are applied to the driver circuit 110. The driver circuit 110 drives the actuating units of selected digit of the display unit 102 in response to the digit selector signals from the multiplexer/digit selector unit 104 so as to display each desired digit.

Figure 15:
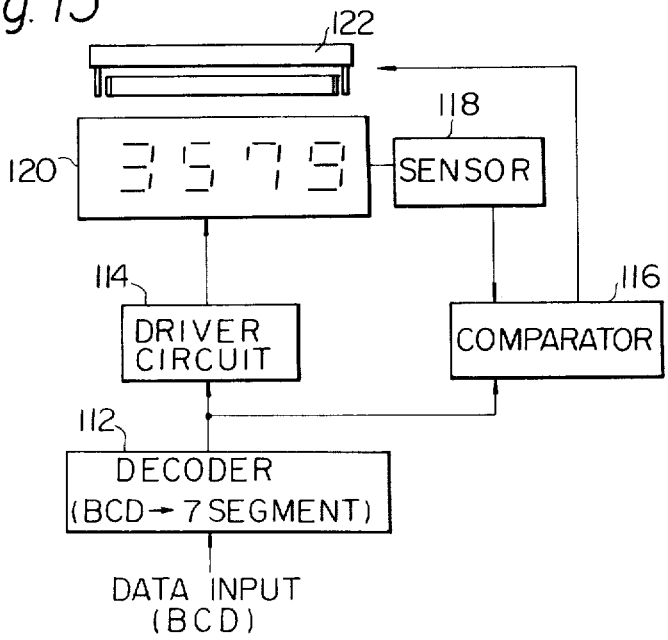
FIG. 15 is a block diagram of another preferrd embodiment of a display device according to the present invention.

Referring to FIG. 15, there is schematically shown an example of a block diagram of an automatic control system for a display unit composed of a plurality of segmental display devices according to the present invention. The automatic control system includes a decoder 112 adapted to convert a BCD data input into decoded signals, a driver circuit 114 arranged to generate drive signals in response to the decoded signals from the decoder 112 to drive each selected actuating unit of the segmental display devices, and a comparator 116 coupled to the decoder 112 and a sensor 118. The sensor 118 may be of any known construction such as a limit switch, a photoelectric sensor, magnetic sensor, etc., insofar as it functions to detect mechanical displacement of each closure member of actuating units or displayed condition of each segment of the display unit 120. Output signals indicative of displayed conditions of each segment is compared with the decoded signal from the decoder 112 by the comparator 116, which generates an inhibiting signal when the displayed conditon of the display unit 120 is out of coincidence with the content of the decoded signals from the decoder 112. The inhibiting signal from the comparator 116 is applied to a light source 122 of the display unit 120, so that the light source 122 is rendered inoperative to prevent incorrect display of the input data.

While the present invention has been shown and described with reference to particular embodiments, it should be noted that various other changes or modifications may be made without departing from the scope of the present invention. For example, while in the illustrated embodiment of FIG. 15 the inhibiting signal is utilized for rendering the light source inoperative to prevent display of all digits, it should be understood that an inhibiting signal from a comparator may be directly applied to actuating units of selected digits to prevent display of all segments of only the selected digits.

What is claimed is:

1. A segmental display device comprising:

a casing;

a window plate mounted at an open end of the casing and having a plurality of segmental openings to provide a display of selected characters;

a light source mounted in said casing rearwardly of the window plate;

a plurality of actuating units, mounted on the rearward side of the window plate at positions adjacent the segmental openings, respectively, for actuating rotatable shafts extending parallel to the plane of the window plate at the sides of the segmental openings, respectively; and a plurality of closure members supported on said rotatable shafts, respectively, to selectively permit light from the light source to pass through selected one of the segmental openings and block the passage of light through another selected one of the segmental openings for thereby providing the display of the selected characters.

2. A segmental display device according to claim 1, further comprising a front plate mounted on said casing forwardly of said window plate.

3. A segmental display device according to claim 1, further comprising a color filter disposed in front of said window plate.

4. A segmental display device according to claim 1, in which said plurality of segmental openings are defined by rearwardly extending frames, and in which selected one of said frames has height greater than those of other frames to provide smooth rotation of said closure members.

5. A segmental display device according to claim 4, in which each of said closure members comprises a closure plate fixedly mounted on said rotatable shaft, and a flexible shutter sheet carried by said closure plate, said flexible shutter sheet being adapted to engage with the frame defining said segmental opening to effectively block out the passage of light.

6. A segmental display device according to claim 5, in which each of said closure members further comprises a spacer disposed between said closure plate and said flexible shutter sheet.

7. A segmental display device according to claim 1, in which each of said actuating units comprises a base plate secured to said window plate and having a vertically extending flange portion carrying thereon said rotatable shaft, a magnetic element rotatably supported by said flange portion and rotatable on an axis parallel to an axis of said rotatable shaft, a linkage connected between said rotatable shaft and said magnetic element for rotating said closure member when said magnetic element is rotated, a magnetic core supported on said base plate and extending toward said magnetic element, and an electromagnetic coil mounted on said core for selectively energizing and rotating said magnetic element.

8. A segmental display device according to claim 7, in which said linkage comprises an actuating arm connected to and rotatable with said rotatable shaft and having formed therein an elongated slot, and an actuating lever connected to and rotatable with said magnetic element and carrying thereon an engaging pin slidable engaging with said elongated slot.

9. A segmental display device according to claim 1, in which each of said actuating units comprises a pair of frames secured to said window plate and carrying thereon said rotatable shaft, a pair of magnetic elements disposed on both sides of a permanent magnet carried by said rotatable shaft, said magnetic elements having lobed portions of varying diameters, a pair of magnetic yokes partially surrounding said magnetic elements in spaced relationship, and a pair of electromagnetic coils mounted on said magnetic cores for selectively energizing said magnetic cores.

10. A segmental display device according to claim 9, in which each of said actuating units further comprises at least one balancing weight connected to said closure member, and a retaining spring for urging said closure member in a closed position.

* * * * *